US005660238A

United States Patent [19]

Earl et al.

[11] Patent Number: 5,660,238

[45] Date of Patent: Aug. 26, 1997

[54] SWITCH ACTUATOR AND FLOW RESTRICTOR PILOT VALVE ASSEMBLY FOR MEASUREMENT WHILE DRILLING TOOLS

[75] Inventors: Leon M. Earl; Borislav J. Tchakarov, both of Lafayette, La.

[73] Assignee: The Bob Fournet Company, Lafayette, La.

[21] Appl. No.: 585,799

[22] Filed: Jan. 16, 1996

[51] Int. Cl.[6] ..... E21B 47/00

[52] U.S. Cl. ..... 175/40; 166/250.01; 367/85

[58] Field of Search ..... 175/40, 45, 48, 175/50, 234; 367/83, 85

[56] References Cited

U.S. PATENT DOCUMENTS

| | | | |
|---|---|---|---|
| 4,686,658 | 8/1987 | Davison | 367/85 |
| 5,073,877 | 12/1991 | Jeten | 367/84 |
| 5,113,379 | 5/1992 | Scherbatskoy | 367/83 |
| 5,238,070 | 8/1993 | Schultz et al. | 166/386 |
| 5,316,087 | 5/1994 | Manke et al. | 166/381 |
| 5,333,686 | 8/1994 | Vaughan et al. | 166/250.01 |
| 5,526,883 | 6/1996 | Breaux | 166/373 |
| 5,592,438 | 1/1997 | Rorden et al. | 367/83 |

*Primary Examiner*—Frank Tsay

*Attorney, Agent, or Firm*—Jesse D. Lambert

[57] ABSTRACT

An apparatus for selectively activating a downhole Measurement While Drilling (MWD) tool, so as to prolong the life of the MWD battery and improve function of the MWD flow restrictor pilot valve assembly, includes a switch actuator responsive to pressure differential disposed incorporated within a fluid sealed pressure chamber which also incorporates a pilot valve assembly for activating the flow restrictor for causing mud pulse signals. The switch actuator comprises upstream and downstream bellows sealing a fluid filled reservoir, with a push-action switch within the upstream bellows, isolated from the drilling fluid. Ports expose the upstream and downstream bellows to longitudinally spaced points in the flowstream, the upstream ports providing flow-through cleaning of the upstream bellows. During drilling fluid flow, a friction pressure loss occurs between the ports, and with flow within desired rates, the resulting pressure differential on the upstream bellows actuates the switch and activates the MWD tool. The flow restrictor pilot valve assembly is partly within the reservoir and comprises a dual dashpot, controlling valve stem movement, with a volume compensating means that permits stem movement within the reservoir without affecting switch actuator function. The actuator integrates the pilot valve length and internal volume so as to minimize the overall length of the actuator and more fully utilize tool length formerly used for a single purpose.

11 Claims, 4 Drawing Sheets

SWITCH ACTUATOR AND FLOW RESTRICTOR PILOT VALVE ASSEMBLY FOR MEASUREMENT WHILE DRILLING TOOLS

BACKGROUND OF THE INVENTION

1. Field of the Invention.

The apparatus of the present invention relates to apparatus capable of being employed downhole in the drill string to sense borehole directional information, temperature, and formation evaluation parameters, and to convey the information to a surface receiver, without withdrawing the apparatus from the hole (referred to as Measurement While Drilling, or MWD, tools). The present invention relates to an improved means to conserve battery energy use by an MWD tool by limiting operation of the MWD tool to periods of desired drilling fluid flow conditions by a switch actuator responsive to a pressure differential generated by fluid flow, yet isolated from the drilling fluid and of an inherently self cleaning design, the switch actuator actuating a switch at the desired times. The invention further relates to a combined flow and rotation sensitive apparatus for activating an MWD tool. The present invention further relates to an improved flow restrictor pilot valve assembly comprising a dual dashpot for controlling valve stem movement, a volume compensating means, and inherently non-plugging and self-cleaning fluid passages.

2. Description of the Related Art.

Originally, oil and gas wells boreholes were not intentionally deviated but rather were drilled as vertical wells, with the drilling rig and surface location of the well situated directly over the desired reservoir penetration target. In particular with the development of the offshore oil and gas industry, directional wells have become quite commonplace. Directional wells are wells that are intentionally deviated from vertical in order to penetrate a subsurface target displaced horizontally some distance from the surface location. It is of critical importance to accurately survey the wellbore to know its angle (deviation from vertical) and azimuth (direction relative to a fixed direction). In offshore operations, drilling directional wells permits multiple wells to be drilled from a single offshore structure, with the surface location of each well displaced only a few feet from one another.

Directional wells in onshore situations are increasingly common. For example, the surface location for a vertical well may be in an environmentally sensitive area, and regulations might make drilling in such an area either prohibited or very expensive; a directional well may permit the surface location to be in an area not having significant environmental concerns.

Additional uses for onshore and offshore directional wells include more efficient exploitation of subsurface reservoirs, by drilling horizontal wells which penetrate multiple generally vertically disposed formation fractures, and wells that penetrate multiple subsurface reservoir targets displaced from one another.

Measurement While Drilling (MWD) tools permit taking multiple directional wellbore surveys without inserting additional survey tools downhole. MWD tools are incorporated into the drillstring downhole and accurately measure wellbore inclination and direction, toolface, temperature, along with other desired parameters, while drilling fluid is being circulated down the drillstring and back to the surface. In addition, the MWD tool, in certain embodiments, can measure various formation evaluation parameters, such as gamma radiation. The tool codes this information into a series of electrical signals which are sent to an electric solenoid or similar means which triggers operation of a flow restrictor pilot valve. The flow restrictor restricts drilling fluid flow in a controlled manner so as to send fluid pressure pulses to the surface for receipt and decoding into borehole directional information and other information as described above.

A downhole battery powers the MWD tool, and it is desirable to conserve battery energy to the greatest extent possible so as to prolong the downhole life of the MWD tool. Energy is conserved by activating the MWD only when desired; for directional survey information, only when drilling is not ongoing (and the drillstring and MWD tool are therefore not rotating, or are rotating only within desired parameters), and when drilling fluid is being circulated. The MWD tool should be "turned off", or in a dormant state, except when combined conditions of non- or slow rotation and sufficient desired circulation rate exist. Typically, the survey device package within the MWD tool has an internal rotation sensor which turns off the tool when the tool is rotating outside of desired parameters. For formation evaluation MWD tools, data may be measured and transmitted while rotary drilling is ongoing, although non-activation during periods of non-rotation is required. It is desirable, then, to additionally have a means responsive to drilling fluid circulation rate to turn the tool on and off.

Prior efforts to incorporate a flow sensitive means to turn the MWD on and off included a rotary turbine. Drilling fluid flow was routed past a shaft-mounted rotatable turbine or propeller which would spin in response. A sensing means responsive to rotation of the turbine shaft would then activate the MWD tool. The turbine means inherently has several operational difficulties. The rotating turbine and shaft assembly is subject to excessive mechanical wear. The abrasive and often corrosive nature of the drilling fluid tends to degrade all exposed turbine parts and invade the internal turbine mechanism unless a perfect seal is in effect about the turbine shaft. Further, the rotation of the turbine could be stopped by solids accumulating about the turbine blades and/or shaft.

The fluid isolated, flow-responsive switch actuator of the present invention avoids the problems presented by turbine means. The present invention utilizes a switch actuator responsive to a pressure differential caused by drilling fluid flow through an annular passage. Upstream and downstream bellows seal a fluid filled reservoir; contained within and cooperatively engaging the upstream bellows is a push-type switch. The downstream portion of the reservoir contains various operating parts of the flow restrictor pilot valve assembly, with the downstream bellows sealing around the stem of the flow restrictor pilot valve. The apparatus is disposed within the bore of a tubular mandrel in the drillstring, or simply disposed within the drillstring bore. Drilling fluid flows through the annulus between the apparatus and the bore, and the friction pressure loss along the longitude of the annulus results in a pressure differential between the two bellows. Ports expose both bellows to the mud flowstream. In addition, both upstream and downstream ports provide constant drilling fluid flow past the bellows to effect a self-cleaning design. As drilling fluid circulation commences, the pressure differential builds between the upstream and downstream points until a pre-set force is reached on the upstream bellows, and in turn on the push-switch therein, when the switch will be actuated and the MWD tool activated. Therefore, since directional surveys and formation evaluation readings are taken only while circulating, the MWD tool is in a dormant state and power consumption is minimized during periods in which the data measurement is not being done.

The resulting required tool length to yield an appropriate pressure differential between two points can cause problems in the assembling and handling of the pressure differential switch actuator apparatus. As a general rule, shorter downhole tools are preferred over longer downhole tools for increased durability and reduction of resonance and vibration problems. The apparatus of the present invention achieves the required spacing needed for adequate pressure differential, while not requiring excessive overall tool length, by utilizing the flow restrictor pilot valve length and internal volume as an integral part of the pressure differential flow switch actuator. By doing so, a greater utilization of existing tool volume is made; in effect, tool length once used solely for the flow restrictor pilot valve is now additionally used to provide pressure port spacing and thus yield a desired pressure differential.

Additionally, the present invention comprises several improvements to the flow restrictor pilot valve assembly. Valve stem travel is controlled at each end of the stem stroke, after release of the stem from latched positions at each end of the stroke, by a dual dashpot arrangement. A volume compensating means allows for volume changes in the switch actuator reservoir caused by the longitudinal movement of the valve stem shaft in the reservoir. Further, the downstream ports admitting drilling fluid to the downstream bellows and allowing fluid flow through the pilot valve comprise at least one aperture having a cross-section area larger at the interior wall of the apparatus than at the exterior wall. As a result, solids in the drilling fluid flowstream larger than the minimum aperture opening can neither pass through the aperture nor bridge and plug the opening. Interior clearances of the parts of the pilot valve are sized correspondingly so as to prevent clogging by entrained solids, the combination of the aperture size and internal clearances creating a non-plugging pilot valve assembly.

The flow switch pilot valve assembly above described represents significant improvement over prior apparatus such as U.S. Pat. No. 5,103,430 to Jeter, et al. discloses a mud pulse signal generator. However, the Jeter apparatus employs only a single dashpot assembly for dampening and control of valve stem movement. The dual dashpot of the present invention provides desired temporal control of the pilot valve stem in both directions of stem stroke, and further prevents "bounce back" of the valve stem off of the servo passage seat and the resulting potentially erroneous mud pulse triggers. In addition, the present invention incorporates an inherently self-cleaning and non-plugging design of the pilot valve, with the combination of the unique downstream slot cross sectional area and the internal fluid clearances. Integration of the pilot valve mechanism into the pressure actuated switch actuator, and incorporation of a volume compensating means to provide for valve stem movement within the actuator reservoir, represent significant advances over prior apparatus.

It is an object of the present invention to provide an improved apparatus for conserving the energy of an MWD tool battery by activating the MWD device only during combined desired conditions of drilling fluid flow rate and MWD tool rotation. Another object of the present invention is to provide a flow rate sensitive switch actuator responsive to a pressure differential between two points, created by drilling fluid flow along a longitude of the MWD tool. Yet another object is to provide a pressure differential operated switch actuator that is self cleaning due to fluid flow past the actuator, and wherein the switch is fluid isolated from the potentially abrasive and/or corrosive drilling fluid.

Another object is to provide a switch actuator and flow restrictor pilot valve assembly that dampens and temporally controls movement of the pilot valve stem at each end of the stem stroke, that provides volume compensation in the switch actuator reservoir so that valve shaft movement does not interfere with the switch actuator function, and has downstream fluid and pressure ports and internal fluid passage sizing so as to be inherently non-plugging.

Still another object is to integrate the MWD tool pilot valve length into the pressure differential switch actuator and thereby create a simple, short, reliable switch actuator by utilizing tool length and volume, formerly dedicated to a single purpose, for multiple purposes.

SUMMARY OF THE INVENTION

The apparatus of the present invention is characterized by an elongated tubular body housing a fluid-isolated, pressure differential operated switch actuator with a pushtype switch cooperatively contained therein. The apparatus may be releasably disposed inside a larger drill collar incorporated into an earthboring drill string, leaving an annulus between the apparatus and the drill collar bore for drilling fluid flow.

As drilling fluid flows longitudinally through the annulus between the apparatus and the drill collar bore, a friction pressure drop occurs, with pressure decreasing in the direction of flow. Pressure ports spaced longitudinally along the apparatus admit pressure to upstream and downstream pressure chambers, each containing bellows, the bellows enclosing a fluid filled reservoir containing a push-type switch and certain parts of the flow restrictor pilot valve. After flow commences, the pressure differential between the spaced apart pressure ports creates a net force on the upstream bellows, engaging the push switch contained therein and activating the MWD tool. Additionally, a rotation sensitive sensor within the MWD directional survey package prevents activation of the MWD survey tool unless tool rotation is within desired parameters. As described above, the formation Directional survey data generated by the MWD tool is then conveyed to a surface receiver by pressure pulses in the drilling fluid flow. The pressure pulses are created by controlled restriction of the drilling fluid flowstream by a flow restrictor. The pilot valve of the flow restrictor has a valve stem extending along a longitude of the apparatus. A dual dashpot controls movement of the stem at the beginning of each stroke. Volume compensating means permit the stem to cycle back and forth without creating undesired pressure forces within the fluid reservoir of the switch actuator. The downstream pressure and fluid ports, along with the internal fluid passages between the pilot valve stem, cocking piston, and seat, are sized so as to make the pilot valve assembly inherently self-cleaning and avoiding plugging the apparatus with solids entrained in the drilling fluid.

DESCRIPTION OF THE PREFERRED EMBODIMENT

While there may be various embodiments of the present invention, with reference to FIGS. 1, 2, 5, and 6 one embodiment is described below.

Figure 1:
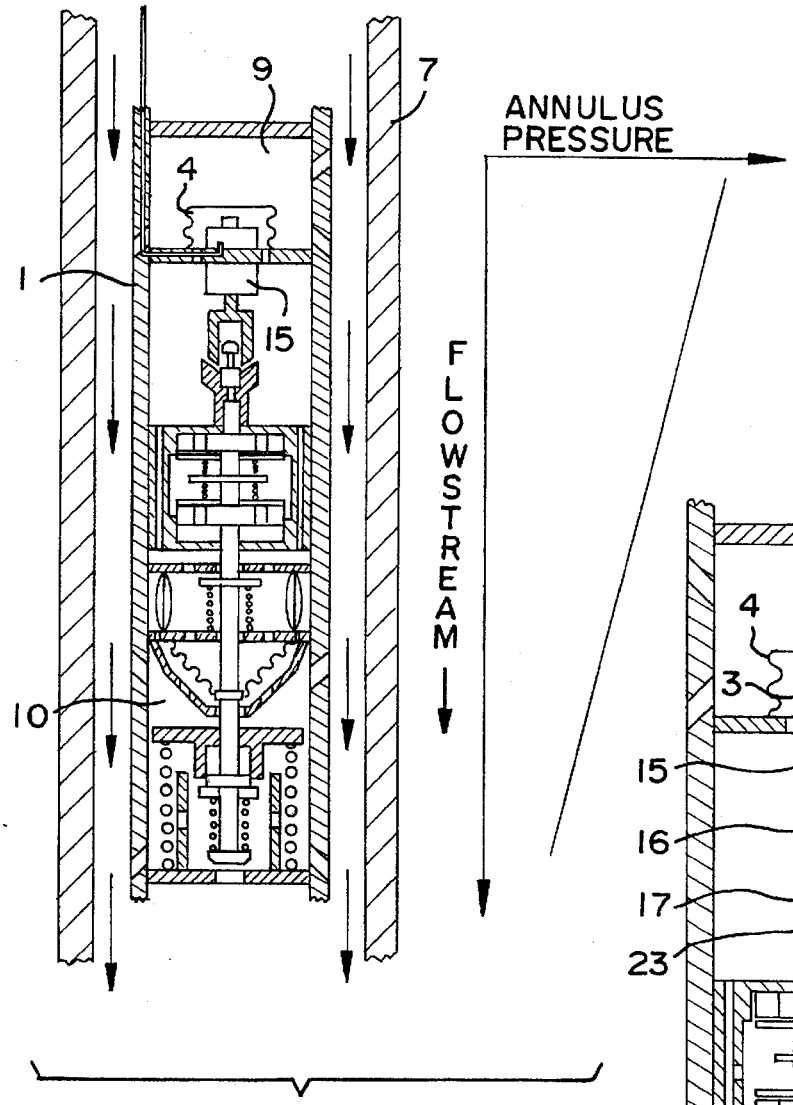
FIG. 1 is a simplified schematical representation of the apparatus of the present invention disposed in a drill collar, showing the drilling fluid flow in an annulus between the apparatus and the drill collar, the locations of the upstream and downstream ports and bellows and an accompanying graph illustrating generally decreasing fluid pressure in the direction of fluid flow.

With reference to FIG. 1, the switch actuator and flow restrictor pilot valve assembly of the present invention is represented in schematical form comprising an elongated tubular body 1 disposed inside the bore of drill collar 7. As the drilling fluid (represented by arrows) flows in the annulus between the elongated tubular body 1 and the drill collar 7 bore, fluid friction causes a pressure differential to exist between upstream ports 2A and 2B and between downstream ports 11A and 11B. The accompanying graph illustrates generally the decreasing fluid pressure in the annulus along the longitude of the apparatus in the direction of fluid flow. Said pressure differential causes a relatively higher fluid pressure to exist in upstream chamber 9 than in downstream chamber 10. As a result, greater pressure exists on the upstream bellows 4 than on the downstream bellows 6.

The force generated by this pressure differential compresses upstream bellows 4 and actuates push-type switch 3 disposed within the upstream bellows 4, as shown and described in further detail hereinafter.

Figure 2:
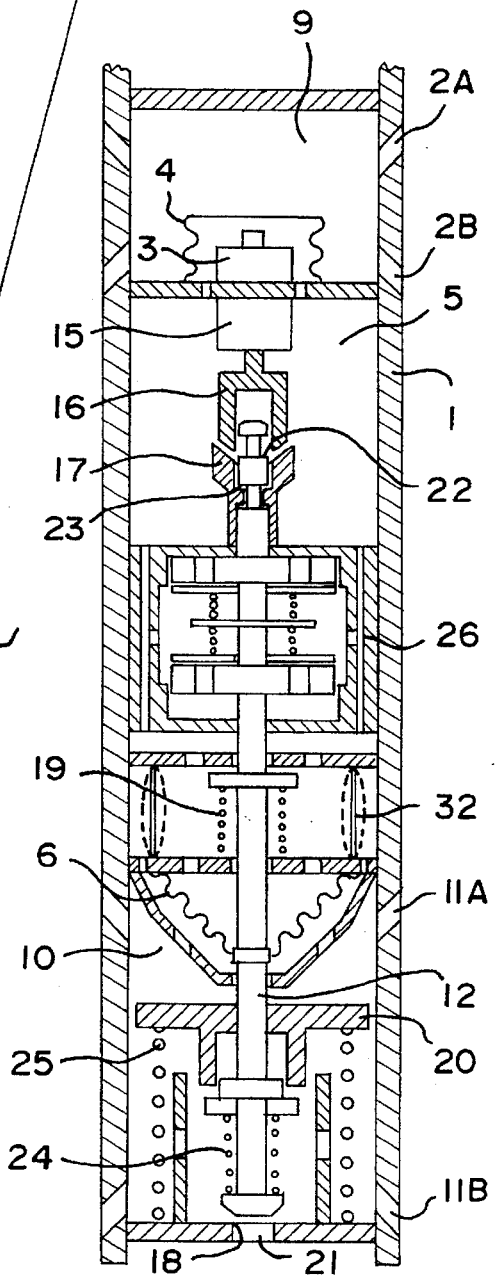
FIG. 2 is a detailed schematic in cross section of the switch actuator and flow restrictor pilot valve assembly of the present invention, showing the integration of the flow restrictor pilot into the switch actuator, all within an elongated tubular body.
Figure 5:
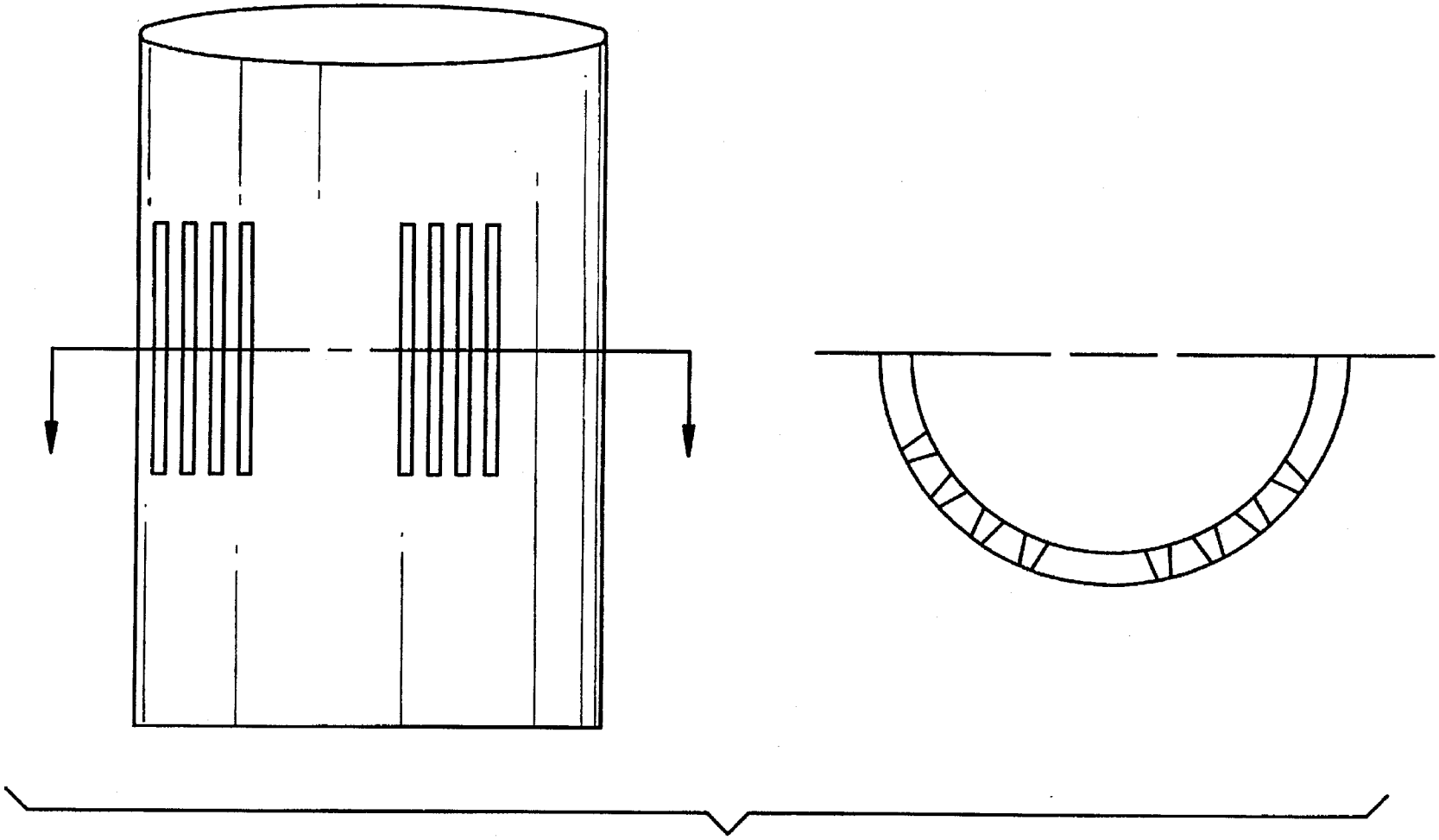
FIG. 5 is a circumferential cross section of one embodiment of the ports showing the varying cross-section area of the ports.
Figure 6:
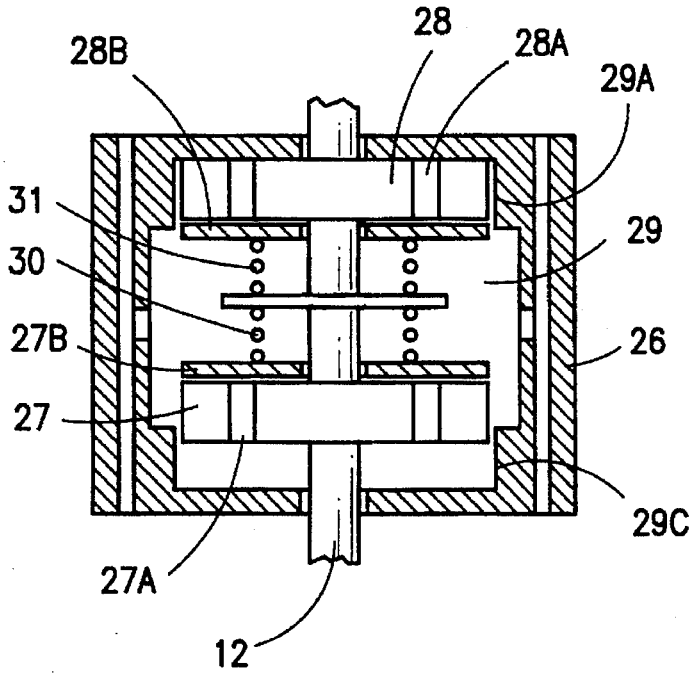
FIG. 6 is a detailed cross section of the dashpot assembly.

With reference to FIGS. 2, 5, and 6, the operation of the present invention is now described. Elongated body 1 is disposed within the bore of a drill collar 7 which is itself made up in an earth bore drillstring. Elongated body 1 is typically centralized within drill collar 7 by means such as taught in U.S. Pat. No. 5,348,091 to Tchakarov et al or other well known means, leaving annular space therebetween. Drilling fluid is pumped from the surface of the borehole down the drillstring and through the annulus between drill collar 7 and the elongated body 1. Due to the pressure differential existing between port 2A and 2B drilling fluid flows therebetween providing self cleaning of solids from chamber 9. Similar self cleaning action occurs in chamber 10 due to fluid flow from port 11A to 11B.

Fluid entering chamber 9 through upstream inlet port 2A pressurizes bellows 4. In preferred embodiment bellows 4 provides a flexible fluid barrier between chamber 9 and chamber 5. Fluid entering chamber 10 through downstream inlet port 11A pressurizes bellows 6. Downstream bellows 6 is sealed about valve stem 12 of the flow restrictor pilot valve assembly and the inner diameter of elongated tubular body 1 thereby providing a flexible fluid barrier between chamber 5 and chamber 10. Chamber 5 is filled with a clean, substantially incompressible fluid such as mineral oil, hydraulic fluid or other similar substance.

As a result of the pressure drop between upstream ports 2A and 2B and between downstream ports 11A and 11B, the net fluid pressure force imposed on the bellows 4 is greater than the fluid pressure imposed on the bellows 6. As a result of said net pressure forces upstream bellows 4 shifts axially, in the direction of fluid flow, activating switch 3. Upon activation switch 3 permits power, typically from a downhole electro-chemical power supply (commonly called and electric battery) associated with the MWD tool. When an insufficient rate of fluid is flowing in drill collar 7 to create enough pressure differential to activate switch 3, switch 3 de-energizes the MWD tool thereby conserving said power supply.

It is understood that the pressure differential between the upstream and downstream pressure chambers 9 and 10 is a function of fluid flow rate, the distance between the chambers 9 and 10, the fluid properties of the particular drilling fluid being circulated downhole and the annular clearance between drill collar 7 and elongated tubular body 1. The above described operational sequence depends on achieving the desired pressure differential between the upstream bellows 4 and the downstream bellows 6, thereby creating a sufficient net axial force to actuate switch 3. In preferred embodiment switch 3 is typically selected to actuate at approximately 2 psi of pressure differential between bellows 4 and bellows 6. In preferred embodiment size of elongated tubular body 1 and the spacing between ports 2A and 11A is design to generate approximately 9 psi pressure differential between ports 2A and 11A under normal drilling fluid circulation conditions. The present invention achieves the required spacing between bellows 2A and 11A with minimal lengthening of the entire MWD tool assembly by integrating switch 3 and the flow restrictor pilot valve assembly (Numbers 12, 15, 16, 17, 19, 20, 22, 26 and 32 of FIG. 2) into chamber 5. Said integration also provides the additional benefit of isolating the components of said valve assembly mechanism from solids contaminated drilling fluid, thereby ensuring greater reliability of said components with minimal maintenance. Accordingly the present invention effectively makes multiple use of the length of chamber 5, utilizing said length to create sufficient pressure differential for activation of switch 3 (in order to conserve power supply when the MWD tool is not needed) and for disposing the pilot valve assembly mechanism therein (providing the additional benefit of isolating said mechanism from damaging well fluids).

Figure 3A:
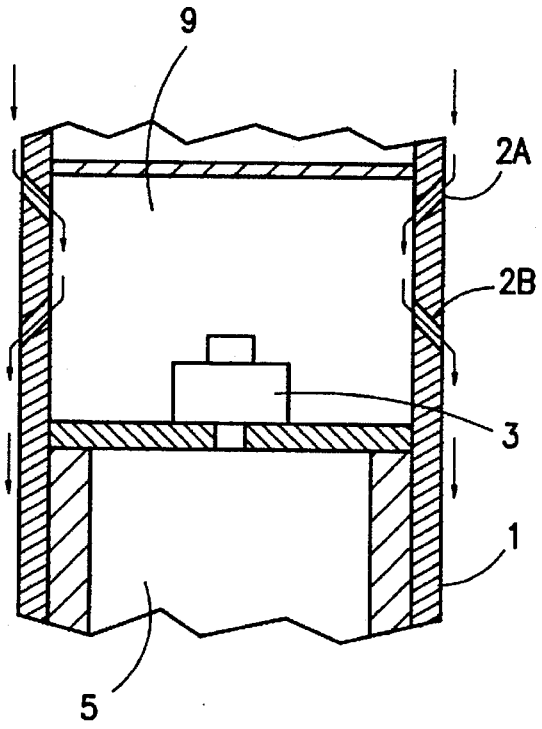
FIG. 3A is a detailed schematic in cross-section of another embodiment of the present invention, showing the push-type switch having an integral protecting bladder.
Figure 3:
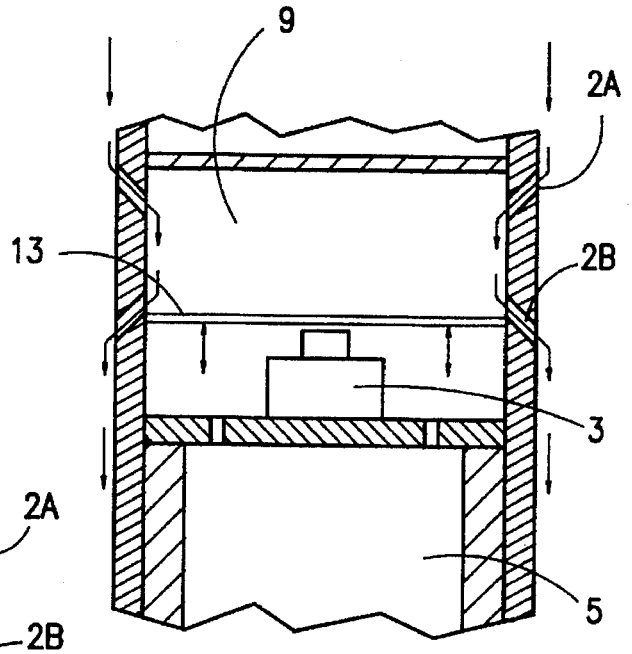
FIG. 3 is a detailed schematic in cross-section of another embodiment of the present invention, showing the push-type switch cooperatively engaged within a flexible bladder responsive to a net pressure force thereon.
Figure 4:
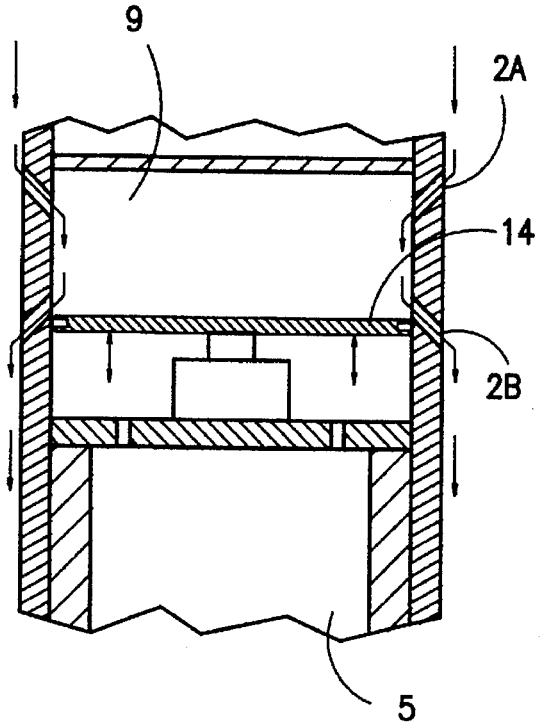
FIG. 4 is a detailed schematic in cross-section of another embodiment of the present invention, showing the push-type switch cooperatively engaged with a sliding piston sealingly engaged within the upstream pressure chamber, the piston movable in response to a net pressure force thereon.

Other embodiments of the present invention are possible. For example, the upstream bellows 4 surrounding push switch 3 could be more generally any fluid isolated, pressure transmitting device, such as a flexible bladder 13 shown in FIG. 3, or a piston 14 in sealing, sliding disposition within the upstream pressure chamber 9 and in operative contact with the push switch 3, as shown in FIG. 4.

The MWD survey package typically has a rotary sensor which permits activation of the survey tool only when the drill string is either not rotating or is rotating slowly (therefore drilling with downhole mud motor, as opposed to typical rotary drilling, is being conducted). Accordingly said rotary sensor conserves the MWD power supply when rotary drilling is being conducted (and directional surveying is not possible). However, under certain non-rotating conditions use of the MWD is also unnecessary (such as tripping in and out of the hole, conditioning drilling fluids, etc.). Under such conditions it is also desirable to conserve the MWD power supply (so as to avoid time consuming, expensive retrieval operations to change MWD tools or power supply). Therefore, the above described rotary sensor (which is not claimed to be invented herein) and flow rate-sensitive switch of the present invention operate in combination to optimize conservation of the MWD power supply. As is seen MWD power supply is conserved unless the combination of both rotation of the drill string and flow conditions are within desired parameters (typically drilling ahead with a downhole mud motor as opposed to both rotary drilling or non-drilling conditions).

As above described, for formation evaluation MWD tools, data may still be gathered while rotary drilling is ongoing. In such cases, the present invention will still be used to limit MWD tool activation to periods of desired drilling fluid circulation rate.

When the MWD is activated as aforesaid, the survey tool sends a series of electrical pulses to the solenoid 15. Solenoid 15 converts said electrical pulses into an axial mechanical pulse. Other devices, such as a rotary solenoids or stepper motors having a threaded output shaft which operated in combination with another threaded member could also be used to convert an electrical pulse into an axial mechanical pulse, could also be used. Solenoid 15, in response to the electrical signal received, drives wedge member 16 to open latch 17. Latch 17 holds stem 12 at both ends of the stem travel stroke. For illustration, operation of the pilot valve will be described starting from the position in which stem 12 is seated on seat 18. When latch 17 opens, by wedge member 16 driven by solenoid 15 (upon receiving an appropriate signal), disengaging from shoulder 22, stem 12 then begins to move toward the opposite extreme of stroke travel, driven in one direction (away from seat 18) by spring 19. Once stem 12 comes "off seat" from seat 18, then drilling fluid begins to flow through downstream ports 11A and 11B, through fluid passages formed by the clearances around cocking piston 20, and through servo passage 21. Spring 19 moves stem 12 to its second position at the full extent of stem travel off seat, where latch 17 engages shoulder 23 on stem 12 and locks stem 12 in its fully off-seat position. Drilling fluid can now flow through ports 11A and 11B and through servo passage 21.

With drilling fluid flowing past cocking piston 20, the relatively small flow area formed by the clearances between cocking piston and stem 12 and the inner wall of tubular member 1 create a pressure drop across, and a resulting force on, cocking piston 20, which moves toward seat 18 in response, compressing springs 24 and 25. Therefore, although latched in an off-seat position, stem 12 is under a spring force by spring 24 tending to move stem 12 toward seat 18.

When the next appropriate electrical signal is received, solenoid 15 again drives wedge member 16 to open latch 17. Stem 12 then begins to move toward seat 18 in response to force from spring 24, under compression by cocking piston 20. When stem 12 seats on seat 18, fluid flow through the servo passage 21 ceases, and the resulting pressure differential and force on cocking piston 20 ends. Cocking piston 20 then moves away from seat 18 driven by springs 24 and 25.

The control of fluid flow through servo passage 21 in turn operates the pulser valve, not shown, which restricts fluid flow and results in pressure pulses being conveyed to the surface for receipt and decoding as borehole directional information.

Movement of stem 12 is dampened at the commencement of shaft travel in either direction by dual dashpot assembly 26, shown in detail in FIG. 6. Pistons 27 and 28 are connected to stem 12, with both pistons slidably disposed within dashpot chamber 29. Pistons 27 and 28 have longitudinal passages 27A and 28A. Piston caps 27B and 28B are spring biased by springs 30 and 31 so as to seat the caps on the pistons and prevent fluid flow through the passages 27A and 28A.

The dampening and controlling function of dual dashpot assembly 26 will now be described, beginning from the stem 12 in the extreme off-seat position, after release of latch 17. As stem 12 begins to move toward seat 18 (in response to force from spring 24), piston cap 28B seats on piston 28, preventing fluid flow through the passages 28A. Fluid passage around piston 28 is therefore restricted due to the tight clearance between piston 28 and reduced diameter section 29A of the dashpot chamber 29. Accordingly, until piston 28 has axially cleared reduced diameter section 29A movement of stem 12 will be slow. When piston 28 has moved into the larger diameter section 29B of dashpot chamber 29, flow area around piston 28 is greatly increased, and movement of stem 12 becomes unrestricted. Piston 27 does not restrict movement of stem 12 towards seat 18 because piston cap 27B lifts off of piston 27 when piston 27 enters reduced diameter section 29C, thereby maintaining a large flow area (through passages 27A). However on any attempt to lift stem 12 from seat 18, piston 27, in combination with reduced diameter section 29C, provides initial damping (identical to that described above) in the opposite direction. These damping forces prevent vibratory and other extraneous forces from causing inadvertent movements of stem 12.

Rapid movement of stem 12 within chamber 5 causes pressure pulses within said chamber. If undamped these pressure pulses can cause inadvertent actuation of switch 3. In order to damp these pressure pulses bladder 32 may be disposed in chamber 5. Other well known pressure pulse damper mechanisms could also be employed, such as bellows or piston means.

In preferred embodiment ports 2A and 11A are designed to resist clogging with solids entrained in the drilling fluid. In preferred embodiment each of said ports, for example port 2A, are in fact multiple passages comprising the form of a plurality of axially elongated slots disposed about a circumference of elongated body 1. In addition, in preferred embodiment, each axially elongated slot is of fine size (about 40 thousands of an inch) and is of smaller width externally than internally (allowing solids which enter the exterior of the slot to pass through to the interior). On the other hand slots 2B and 11B being effluent slots are wider and typically untapered (so as to allow fine solids which enter either chamber 9 or 10 to pass unimpeded therethrough).

For further protection of the present invention from clogging due to solids entrained in the drilling fluid the internal clearances for fluid passage between cocking piston 20, stem 12, and the associated wall of the elongated tubular body 1 are such that any solids passing through the port 11A will pass unimpeded through the tool and servo passage 21. During periods of rotary drilling the placement of port 11B permit a limited flow-through around the cocking piston to continue self-cleaning even when the MWD is not in use.

Figure 7:
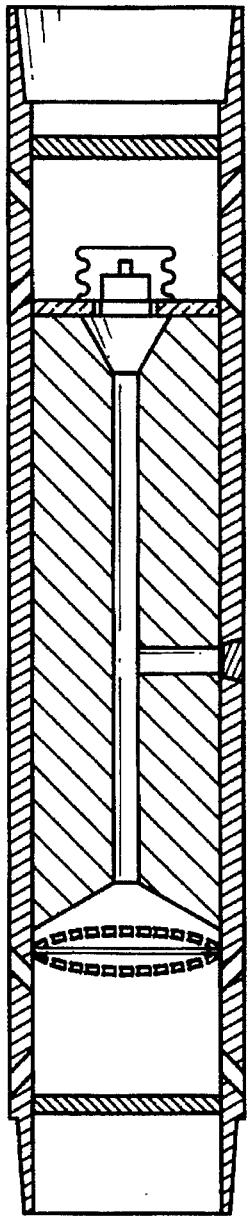
FIG. 7 is a cross section schematic of another embodiment of the switch actuator.

As an alternative, should length of the apparatus be of no concern, it is possible to embody the MWD flow switch described above in the stand-alone form of FIG. 7 (which does not incorporate the pilot valve assembly therein).

Many other embodiments of the present invention will be apparent to those skilled in the art, without departing from the spirit and intent of the invention, the full scope of which is intended to comprehended by the following claims and the equivalents thereof.

We claim:

1. An apparatus for conserving the energy of a downhole measurement while drilling tool battery, comprising in combination:

a first switch means responsive to a differential pressure between at least two points disposed longitudinally along said downhole measurement while drilling tool, said differential pressure generated by drilling fluid flow between said points; and a second switch means responsive to rotation of said measurement while drilling tool, said first and second switch means activating said measurement while drilling tool only during desired combined conditions of drilling fluid flow and measurement while drilling tool rotation.

2. A downhole measurement while drilling tool, comprising:

a battery powered downhole data acquisition means for measuring wellbore directional and formation evaluation data;

a first switch means for activation of said data acquisition means, said first switch means responsive to rotation of said measurement while drilling tool and activating said surveying means only when said rotation is within desired parameters; and a second switch means for activation of said data acquisition means, said second switch means responsive to a pressure differential between at least two points along a longitude of said measurement while drilling tool, said pressure differential generated by drilling fluid flow past said points, said second switch means activating said data acquisition means only during desired conditions of drilling fluid flow.

3. A self cleaning, fluid isolated switch actuator for a downhole measurement while drilling tool, comprising:

an elongated tubular body having upstream and downstream pressure chambers therein;

inlet and outlet ports providing drilling fluid flow into and out of said upstream pressure chamber;

inlet ports providing drilling fluid into said downstream pressure chamber;

a fluid reservoir within said elongated tubular body, said reservoir defined by an upstream fluid isolating means within said upstream pressure chamber, a longitudinal channel within said elongated tubular body, and a downstream fluid isolating means within said downstream pressure chamber, each of said fluid isolating means movable in response to a pressure differential imposed thereon;

a switch disposed within said fluid reservoir proximal to said upstream pressure chamber and cooperatively engaging said upstream fluid isolating means, said switch moved between on and off positions by movement of said fluid isolating means in response to a differential pressure imposed thereon, said switch controlling activation of said measurement while drilling tool thereby.

4. The switch actuator of claim 3, wherein said upstream and downstream fluid isolating means comprise flexible bellows.

5. The switch actuator of claim 3, wherein said upstream fluid isolating means comprises a flexible bladder.

6. The switch actuator of claim 3, wherein said upstream fluid isolating means comprises a sliding piston sealingly disposed within said upper pressure chamber.

7. The switch actuator of claim 3, wherein said switch comprises an integrated flexible fluid isolating means.

8. A measurement while drilling tool comprising:

a flow restrictor valve;

a pilot valve disposed within a chamber which isolates said pilot valve from wellbore fluids; and, means for damping initial movement of said pilot valve from both a fully extended and a fully retracted position but allows unrestricted movement after initial movement in either direction has occurred.

9. The measurement while drilling tool of claim 8 wherein axial stroking of the pilot valve assembly, in either direction, is produced in response to a momentary mechanical pulse in only one direction.

10. The measurement while drilling tool of claim 9 wherein said momentary mechanical pulse is produced by an electro-mechanical solenoid having an axial output shaft.

11. The measurement while drilling tool of claim 8 wherein said chamber also comprises:

an electric switch means for activation of said measurement while drilling tool responsive to a pressure differential of sufficient magnitude existing between axial ends of said chamber.

* * * * *